United States Patent [19]

Ghiaro

[11] Patent Number: 4,572,246

[45] Date of Patent: Feb. 25, 1986

[54] WEFT YARN PRESENTING DEVICE FOR LOOMS

[75] Inventor: Fiorenzo Ghiaro, Vigliano Biellese, Italy

[73] Assignee: ROJ Electrotex S.p.A., Vercelli, Italy

[21] Appl. No.: 593,487

[22] Filed: Mar. 26, 1984

[30] Foreign Application Priority Data

Mar. 25, 1983 [IT] Italy ..... 20308 A/83

[51] Int. Cl.[4] ..... D03D 47/30

[52] U.S. Cl. ..... 139/435

[58] Field of Search ..... 139/435, 453, 439

[56] References Cited

U.S. PATENT DOCUMENTS 3,237,651 3/1966 Ancet ..... 139/453
3,412,763 11/1968 Wueger ..... 139/453
3,825,038 7/1974 Ormerod ..... 139/453
4,326,565 4/1982 Van Mullekom ..... 139/435

FOREIGN PATENT DOCUMENTS 91505 10/1983 European Pat. Off. ..... 139/439
183135 9/1966 U.S.S.R. ..... 139/435

*Primary Examiner*—Werner H. Schroeder
*Assistant Examiner*—S. Shongut
*Attorney, Agent, or Firm*—Young & Thompson

[57] ABSTRACT

A weft yarn presenting device for shuttleless looms, especially air looms, feeding weft yarns of different colors, comprises a plurality of nozzles joined in a bundle and carried by a body mounted on two supports arranged at 90° one from the other, and two actuators adapted to be operated simultaneously and imparting to said supports rectilinear movements in both senses, along two directions perpendicular to each other and to said body.

1 Claim, 3 Drawing Figures

WEFT YARN PRESENTING DEVICE FOR LOOMS

BACKGROUND OF THE INVENTION

The present invention relates to a device—of the type usually called "presenting device"—designed to methodically feed to the weft insertion members of shuttleless looms, different weft yarns of various colors which have been previously arranged by weft supply devices, for the continuous and almost tensionless feeding thereof.

Several devices of this type are already known to work with satisfactory results on common shuttleless looms, wherein continuous weft feeding is carried out by means of grippers or similar mechanical devices.

Nevertheless, these known presenting devices—comprising as many eyelet rods as there are weft yarns, apt to be shifted one at a time from an inactive position to a weft yarn feeding position—have already shown their limits in the more improved gripper looms, with high weaving speed, and are positively unfit for the faster air or water type looms.

SUMMARY OF THE INVENTION

The presenting device according to the present invention—which is very fast, precise and safe—is based on a fully original conception, allowing to overcome the limits of the known devices whereby as well as being advantageously used in shuttleless looms having mechanical weft yarn insertion members, it is particularly fit for use on air looms, being fed with weft yarns of various colors.

The presenting device according to the invention is characterized by the fact that it comprises a plurality of nozzles joined in a bundle and carried by a body, said body being mounted on two supports arranged at 90° one from the other, and two actuators adapted to be operated simultaneously and imparting to said supports rectilinear movements in both senses, along two directions perpendicular to each other and to said body.

Said actuators can be hydraulic, oleodynamic, electric or of other type.

A particularly interesting and advantageous preferred embodiment of the invention provides for four nozzles arranged into a square.

BRIEF DESCRIPTION OF THE DRAWINGS

The invention will now be described in further detail, by mere way of example, with reference to a preferred embodiment thereof, illustrated in the accompanying drawings, in which.

DESCRIPTION OF THE PREFERRED EMBODIMENT

With reference to the drawings—which relate to a presenting device feeding four colors—the device according to the invention fundamentally comprises four nozzles 1, 2, 3 and 4, forming a bundle into a single unit or body 5, in which they are arranged side-by-side in a square and from which they widely project.

Figure 1A:
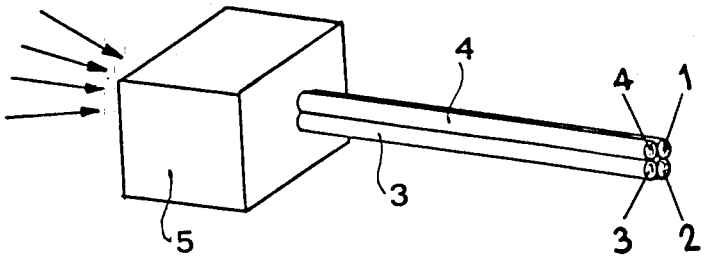
FIG. 1 is a diagrammatic perspective view of the central body of the presenting device according to the invention.
Figure 1B:
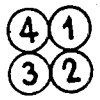
Figure 2:
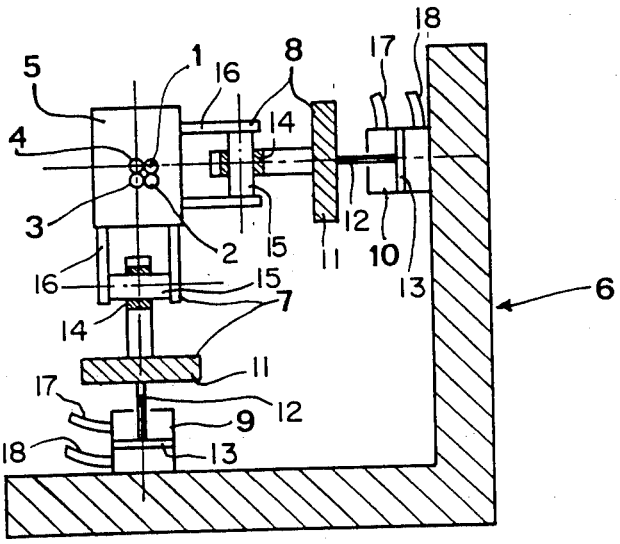
FIG. 2 is a cross section of the presenting device.

As shown in FIG. 2, the body 5 of the presenting device is mounted onto a support system 6, allowing to easily move the desired nozzle into the exact working position, at equal time intervals.

The support system 6 comprises a pair of supports 7 and 8, which are arranged at 90° one from the other and connected to two adjoining sides of the body 5, and to which rectilinear movements in both senses, along two directions perpendicular to each other and to said body 5, can be imparted by respective actuators 9 and 10, which can be hydraulic or oleodynamic (as shown in the drawing) or else of another type, as for instance electric, and which can be operated simultaneously so as to impart to the body 5 diagonal movements.

Each support 7 or 8 comprises a head 11 which is secured to and moved by the piston rod 12 of the piston 13 of the associated actuator 9 or 10. Each head 11 carries a sleeve 14 within which slides a pin 15 mounted between the legs of a yoke 16 on body 5. Fluid under pressure is supplied to opposite sides of the pistons 13 through conduits 17 and 18 connected to a conventional source of fluid under pressure (not shown).

Figure 3:
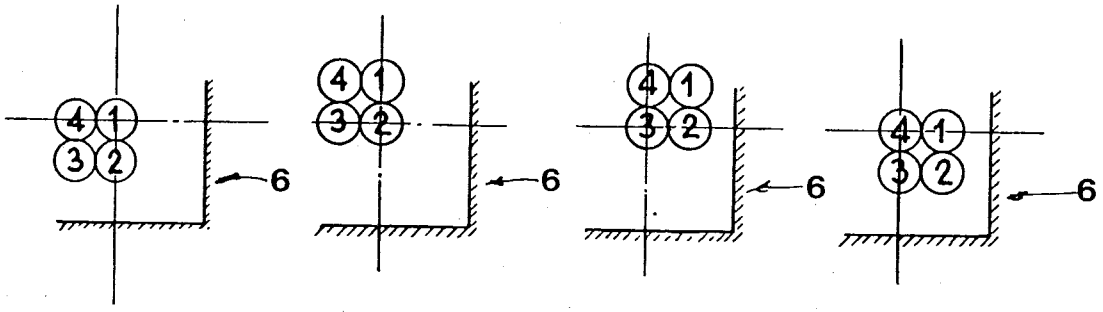
FIG. 3 diagrammatically illustrates the working of said presenting device.

FIG. 3 diagrammatically illustrates the four positions which can be taken up by the body 5 of the presenting device, with the four nozzles in an orderly working position.

The simultaneous use of the two actuators 9 and 10 allows the shiftings from the position of use of the nozzle 2 to the position of use of the nozzle 4, and from the position of use of the nozzle 1 to the position of use of the nozzle 3—and vice versa—to be carried out with diagonal movements, taking substantially the same amount of time as that required to move from the position of use of each nozzle to the position of use of the adjoining nozzle.

In this way, the weft yarns of four colors, fed by four weft supply devices and let through the nozzles 1, 2, 3 and 4 of the presenting device, may be singly and promptly prearranged for gripping by the means which will transport them through the warp shed of the loom, whether these means are mechanical devices, as grippers or the like, or whether they consist of an air jet or a water spout.

There is no need to insist on the structural simplicity, precision, reliability and efficiency of the heretofore described device, as these characteristics appear quite evident.

I claim:

1. A weft yarn presenting device for looms, comprising a plurality of nozzles joined in a bundle and carried by a body, two actuators each connected to the body, one said actuator moving the body reciprocally in only one direction, the other said actuator moving the body reciprocally in only one other direction, the two said directions being at right angles to each other, and means for selectively or simultaneously actuating said actuators, said nozzles being disposed in a square pattern, the sides of the square being parallel to said directions, whereby when the actuators are individually actuated they move the body in those directions and when they are simultaneously actuated they move the body along the diagonals of the square, each actuator comprising a head, means for moving said head only along the associated said direction, and means interconnecting each head with the body for relative sliding movement only in the other said direction.

* * * * *

UNITED STATES PATENT AND TRADEMARK OFFICE

CERTIFICATE OF CORRECTION

PATENT NO. : 4,572,246

DATED : Feb. 25, 1986

INVENTOR(S) : Fiorenzo Ghiardo

It is certified that error appears in the above-identified patent and that said Letters Patent is hereby corrected as shown below:

On the title page, Item [75] Inventor: "Ghiaro" should read -- Ghiardo --.

Signed and Sealed this

*First* Day of *July 1986*

[SEAL]

*Attest:*

*Attesting Officer*

DONALD J. QUIGG

*Commissioner of Patents and Trademarks*